US007621148B1

(12) United States Patent
Dain et al.

(10) Patent No.: US 7,621,148 B1
(45) Date of Patent: Nov. 24, 2009

(54) ULTRA-LOW TEMPERATURE BIO-SAMPLE STORAGE SYSTEM

(76) Inventors: John F. Dain, P.O. Box 1418, Hollister, CA (US) 95024; Elizabeth L. Dain, P.O. Box 1418, Hollister, CA (US) 95024; Nicholas J. Henneman, P.O. Box 1418, Hollister, CA (US) 95024

( * ) Notice: Subject to any disclaimer, the term of this patent is extended or adjusted under 35 U.S.C. 154(b) by 239 days.

(21) Appl. No.: 11/890,451

(22) Filed: Aug. 7, 2007

(51) Int. Cl.
*F25D 11/00* (2006.01)

(52) U.S. Cl. ..... 62/440; 62/441; 220/592.01

(58) Field of Classification Search ..... 62/440, 62/441; 220/560.04, 560.05, 560.1, 560.12, 220/560.13, 560.15, 592.01, 592.02, 592.05, 220/592.09, 592.1, 592.23, 592.24, 592.25, 220/529.26, 592.2; 312/400, 405, 407, 291, 312/404

See application file for complete search history.

(56) References Cited

U.S. PATENT DOCUMENTS

| | | | | |
|---|---|---|---|---|
| 2,727,363 | A * | 12/1955 | Fenner | 62/289 |
| 3,601,186 | A | 8/1971 | Smith et al. | |
| 3,673,810 | A | 7/1972 | Hales et al. | |
| 3,699,694 | A | 10/1972 | Hales et al. | |
| 4,040,268 | A | 8/1977 | Howard | |
| 4,060,400 | A | 11/1977 | Williams | |
| 4,257,752 | A | 3/1981 | Fogarty | |
| 4,276,752 | A | 7/1981 | Modler et al. | |
| 4,454,723 | A | 6/1984 | Weasel et al. | |
| 4,580,411 | A | 4/1986 | Orfitelli | |
| 4,768,535 | A | 9/1988 | Marx et al. | |
| 4,860,545 | A | 8/1989 | Zwick et al. | |
| 5,331,824 | A | 7/1994 | Miller et al. | |
| 5,353,749 | A | 10/1994 | Seibel et al. | |
| 5,440,894 | A | 8/1995 | Schaeffer et al. | |
| 5,600,966 | A | 2/1997 | Valence et al. | |
| 5,743,111 | A | 4/1998 | Sasaki et al. | |
| 5,884,696 | A | 3/1999 | Loup | |
| 5,910,167 | A | 6/1999 | Reinke et al. | |
| 5,947,195 | A | 9/1999 | Sasaki | |
| 6,128,914 | A | 10/2000 | Tamaoki et al. | |
| 6,185,957 | B1 | 2/2001 | Voss et al. | |
| 6,345,509 | B1 | 2/2002 | Garlov et al. | |
| 6,390,187 | B1 | 5/2002 | Marechal et al. | |
| 6,438,990 | B1 | 8/2002 | Hertling | |
| 6,453,680 | B1 | 9/2002 | Allen | |
| 6,490,877 | B2 | 12/2002 | Bash et al. | |
| 6,543,240 | B2 | 4/2003 | Grafton | |
| 6,578,367 | B1 | 6/2003 | Schaefer et al. | |
| 6,606,882 | B1 | 8/2003 | Gupte | |
| 6,619,047 | B2 | 9/2003 | Ziegler et al. | |
| 6,804,976 | B1 | 10/2004 | Dain | |
| 7,263,845 | B2 | 9/2007 | Lee | |
| 2005/0138956 | A1 | 6/2005 | Okuda et al. | |
| 2006/0086741 | A1 | 4/2006 | Bacon et al. | |

* cited by examiner

*Primary Examiner*—Cheryl J Tyler
*Assistant Examiner*—Justin Loffredo
(74) *Attorney, Agent, or Firm*—J. E. McTaggart

(57) ABSTRACT

An ultra low temperature freezer is optimized with a combination of vacuum and fiberglass insulation for long-term biological storage with accurate process cooling with critical temperature performance. A programmable cooling and cryogenic freezing system uses sealed liquid nitrogen for cooling and freezing. A hybrid completely non-mechanical system exhibits temperature uniformity and reliability, saves space, requires extremely low operating energy and minimizes need for air conditioning in the operating environment. Top-located components control the flow of liquid nitrogen even under flooding conditions. Sectioned inner doors mitigate thermal transfer to other samples and maintain ULT while accessing the freezer.

7 Claims, 4 Drawing Sheets

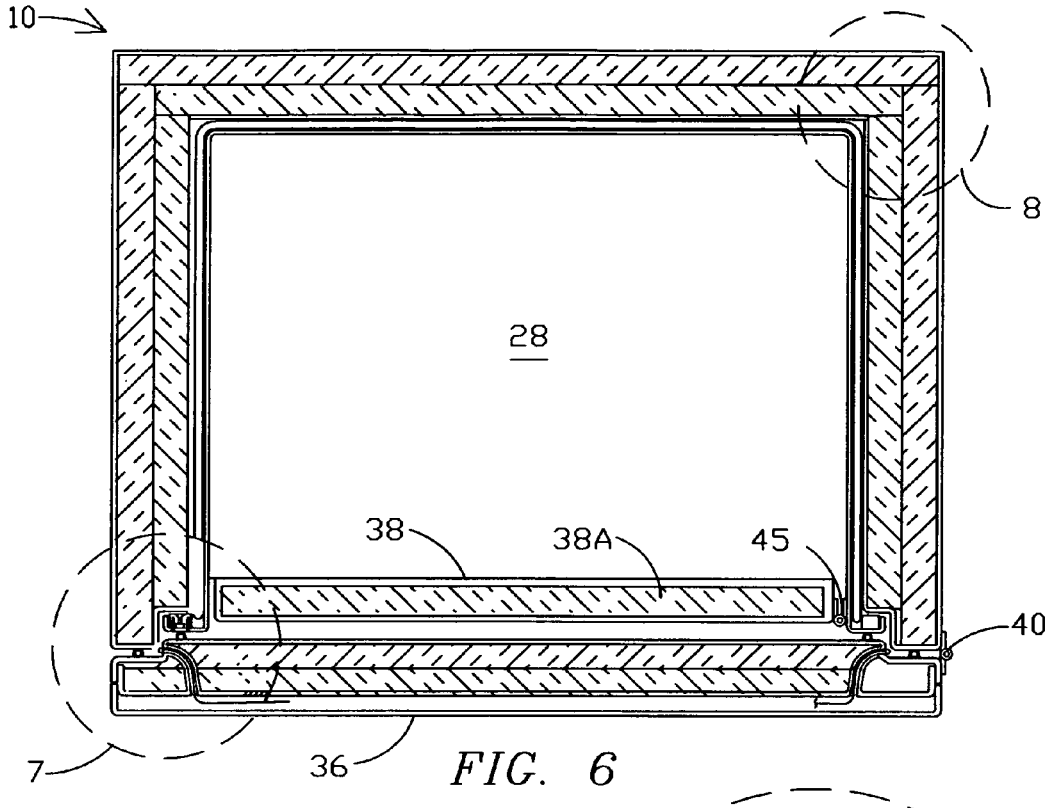
FIG. 6
FIG. 7
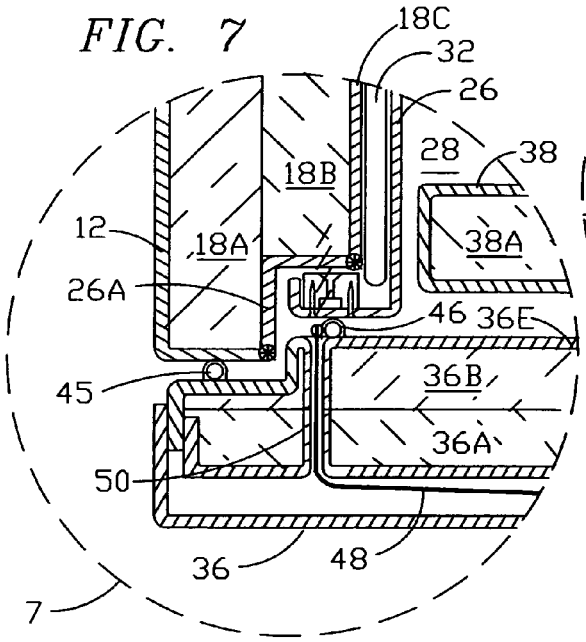
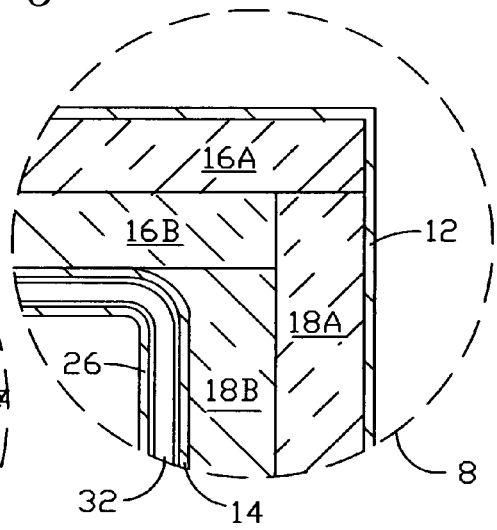
FIG. 8

ULTRA-LOW TEMPERATURE BIO-SAMPLE STORAGE SYSTEM

FIELD OF THE INVENTION

The present invention is in the field of coolers and refrigerators; more particularly high reliability refrigerated storage systems suitable for long term storage of biological samples at ULT (ultra low temperature), typically lower than −90 degrees C.).

BACKGROUND OF THE INVENTION

There is an increasing need for reliable bio-sample storage at temperatures ranging from room temperature (20 degrees C.) down to ULT as low as −150° degrees C. Since these bio-samples include sensitive tissues and vaccines for protecting against pan-epidemics that could break out naturally or by acts of terrorism, the insulation systems for their storage are required to not only develop the required low temperature, but to continuously maintain that temperature accurately and reliably since even temporary loss of cooling could weaken, damage or even destroy existing supplies of vaccines, etc. Many of such stored substances are precious, e.g. very costly and having been accumulated over a long period of time, thus requiring an extremely long time for replacement, so loss in storage could place large populations at risk.

The structure of the door(s) and load location in the enclosure are critical considering temporary temperature rise during time periods when the door is open for loading and unloading samples.

DISCUSSION OF KNOWN ART

Many refrigeration systems of known art have limitations in temperature range and reliability that would preclude their utilization in this demanding field of endeavor. Depending on their configuration, the open-door time required for loading or unloading samples could allow an unacceptable rise in temperature. Conventional ULT systems without redundant evaporators and/or highly efficient thermal insulation have a very short survival time, typically only a few hours, before loss of set point temperature, in the event of failure due to leakage of refrigerant, line blockage. motor or pump failure, electrical power outage or many other potential causes.

In known competitive refrigeration equipment, thermal insulation efficiency is often compromised in a tradeoff for cost savings. Not only would the resultant higher operating cost be detrimental in the field of bio-sample storage, but, more importantly, high thermal insulation efficiency is an essential key factor in the survival of stored samples in the event of down time of the cooling unit, e.g. due to electrical power outages.

In many known refrigeration systems the cooling unit with electrical/electronic components is located close to floor level, where it is vulnerable to early failure under flooding conditions.

U.S. Pat. No. 6,804,976 issued Oct. 19, 2004 to the present inventor for a HIGH RELIABILITY MULTI-TUBE THERMAL EXCHANGE STRUCTURE discloses a system of heat exchange tubes configured in multiple parallel runs for high reliability through redundancy in a thermal chamber.

OBJECTS OF THE INVENTION

It is a primary object of the present invention to provide a single programmable cooling and cryogenic freezing system optimized for long term storage of biological items with accurate process cooling and reliable temperature performance for critical requirements.

It is an object for the system to provide controlled temperature storage in a range +20 degrees to ULT, e.g. as low as −150 degrees C., with accurate capability of both programmed temperature variations and continuous constant temperature.

It is an object to provide unusually high thermal insulation efficiency for low operating cost and more importantly for capability of surviving a substantial time period, e.g. several days, of electrical power outage or other refrigeration interruption.

It is an object to provide protection against risk of contamination and/or frost buildup due to enclosure "inhalation" of external air containing contaminants and/or moisture.

It is an object to provide a door structure and multiple storage arrangements that minimize temperature rise deviation due to loading and unloading samples.

It is a further object to provide the system with capability of continuing to function in case of emergencies such a flooding up to several feet of water.

SUMMARY OF THE INVENTION

The abovementioned objects and other advantages have been accomplished by the present invention of a single system that is optimized for long-term biological storage with accurate process cooling and critical temperature performance. As a programmable cooling and cryogenic freezing system, it uses sealed liquid nitrogen (LN2) refrigerant for accurate, effective and efficient cooling and freezing. The field-tested hybrid completely non-mechanical system exhibits superior temperature uniformity and reliability, saves space, requires up to 90% less operating energy than known competitive units and minimizes need for air conditioning in its operating environment.

The electronic control components are located in a plenum region at the top of the unit where it can continue to operate and control the flow of LN2 even under flooding conditions with water rising to several feet.

Optional positive pressure or equilibrium of internal and external barometric pressure reduces "inhale" of external air, mitigates introduction of contaminants and minimizes frost buildup.

Combination of vacuum and "glass bead" insulation-filled construction allows the system to continue flawless operation even if vacuum is breached.

Reliability is enhanced by the utilization of a multiple evaporator tube system based on the patent referenced above.

Double seals around the door are pressurized for positive sealing in normal service and are depressurized for convenient access via the door.

Sectioned inner doors mitigate thermal and cross-contamination transfer to other samples and maintain ULT in other compartments while accessing one compartment.

BRIEF DESCRIPTION OF THE DRAWINGS

Other features and advantages of the present invention will be apparent to those skilled in the art from a careful reading of the following detailed description and accompanying drawings.

FIG. 6 is a cross-sectional view taken at 6-6 of FIG. 4.

FIG. 7 is an enlarged view of the circled left hand front corner region 7 of FIG. 6.

FIG. 8 is an enlarged view of the circled high hand rear corner region 8 of FIG. 6.

Other features and advantages of the present invention will be apparent to those skilled in the art from a careful reading of the following detailed description and accompanying drawings.

DETAILED DESCRIPTION

Figure 1:
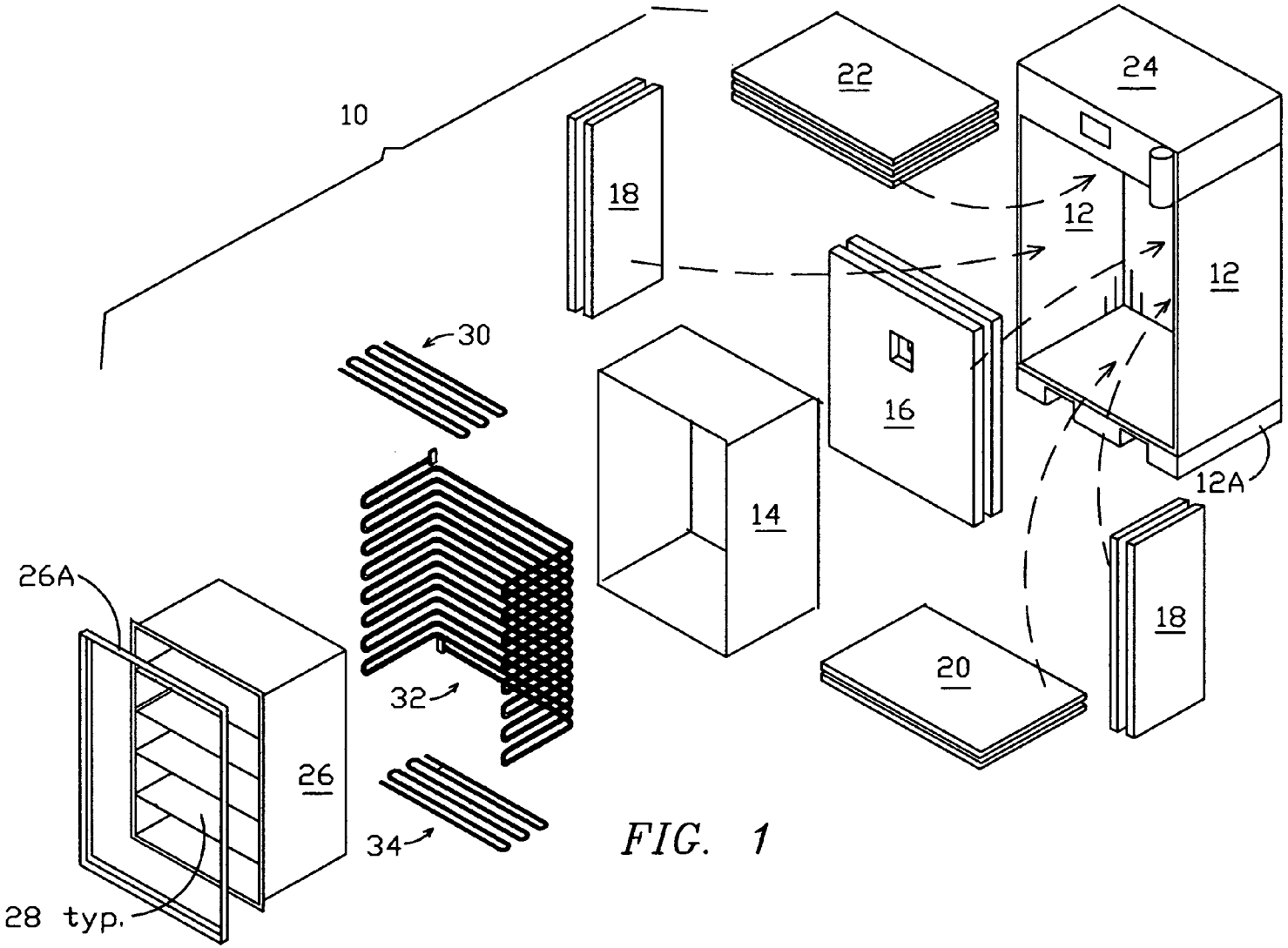
FIG. 1 is an isometric exploded view of the major component parts of a ULT freezer for cryogenic preservation.

In FIG. 1, an isometric exploded view of the major component parts of a ULT freezer 10 of the present invention in an embodiment for cryogenic preservation, the outer shell 12 and inner shell 14 are five-sided boxes made from stainless steel sheet material. A set of flat insulation fillers 16-22 made from high efficiency thermal insulating material are dimensioned to line the inside of enclosure 12 at the bottom, rear, both sides and top respectively. Typically the rear filler 16 and side fillers 18 are each formed in two layers, each two inches thick. The top filler 22 may be made thicker than the others, e.g. three or four layers, while the bottom filler 16 may be made thinner, e.g. a single layer, or even omitted as an option.

The top region of freezer 10 above outer shell 12 is configured with a plenum region 24 for containing operational components such as valves and controls and is preferably provided with a display panel 24A in the front location shown, providing a touch-screen human manual interface (HMI).

The bottom of enclosure 12 can be made simple and flat for platform or tabletop locations, or, for floor mounting, the bottom is configured with spacer feet, as shown, to elevate the bottom panel for ventilation and enhanced safety against environmental risks such as flooding.

The walls of the interior storage chamber 26, a.k.a. the "payload tub", are also made from stainless steel sheet material. Chamber 26 is configured internally with a set of shelves 28 forming a set of typically five stacked storage compartments. Shelves 28 may be made of solid sheet stainless steel to enhance thermal independence between compartments and fixed in location to support slide-in trays which can be solid or "wire-basket" trays that can slide-in on the shelves or preferably mounted to the chamber interior walls with slides on each side for convenience.

Assembled around the exterior of storage chamber 26 are a set of evaporator tube assemblies: a flat top unit 30, a U-shaped unit 32 that wraps around the rear and both sides, and a flat bottom unit 34 which may be made smaller than top unit 30 or else omitted as an option. These evaporator tube units contain multiple side-by-side tubing runs, typically of copper tubing, for reliability through redundancy as disclosed in U.S. Pat. No. 6,804,976 to present joint inventor John F. Dain. Manifolds and control valves for selectively connecting the evaporator tube units are located in the plenum region 24. A metal jamb frame 28 is to be fastened, preferably welded, in place between the front edges of outer shell 12 and inner shell 14.

Figure 2:
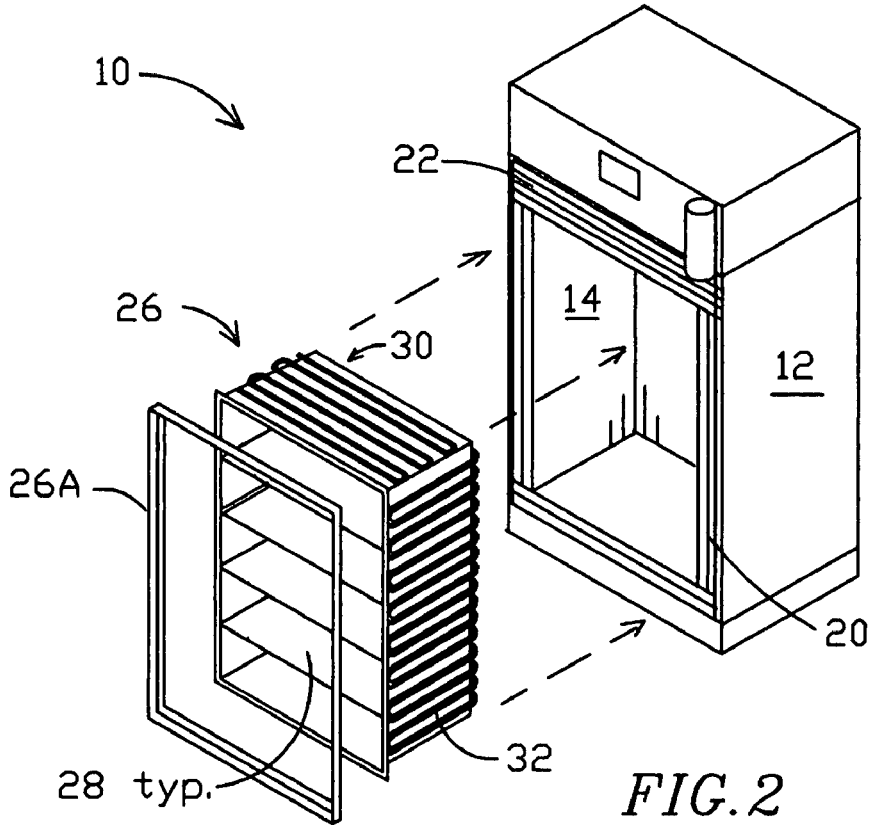
FIG. 2 depicts the components of FIG. 1 assembled into two main portions.

FIG. 2 shows the components of FIG. 1 assembled into two major sub-assemblies ready to be assembled together with each other: the outer shell 12 with insulation fillers and inner shell 14 installed and the main chamber 26 with the evaporator tube units mounted in place (30 and 32 visible).

Figure 3:
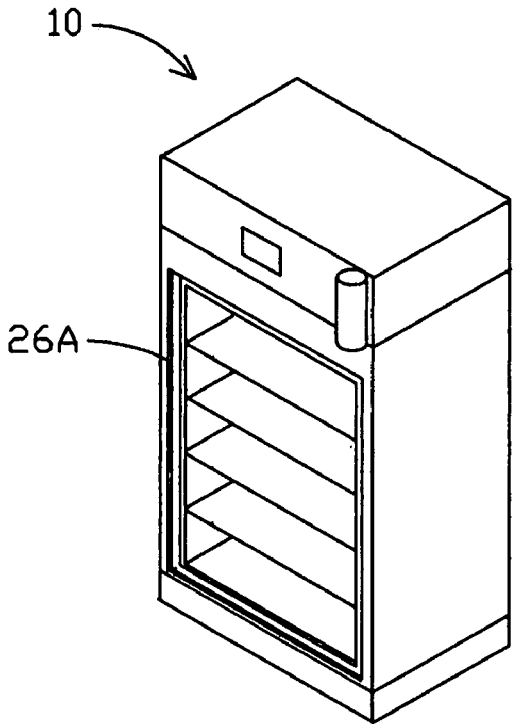
FIG. 3 depicts the two portions of FIG. 2 assembled together into a single unit.

FIG. 3 shows the two sub-assemblies of FIG. 2 having been assembled together. A jamb flange 26A of stainless steel sheet is formed around the front edge of outer shell and inner shell 14, with welded seams to form an airtight insulated overall insulation zone made up from typically five orthogonal-shaped zones that, along with a front door, can be initially dehydrated with a pressure/heat procedure then evacuated for high efficiency, moisture-free insulation performance for low operating costs and long set point survival time in the event of virtually any type of failure.

The insulation material utilized, e.g. Dow Corning Tymer 6000 composed of small glass beads adhered together in a slab or panel of the fillers, accomplishing superior insulation as well as providing the necessary high compressive strength, e.g. 6,000 p.s.i., for holding the stainless steel inner and outer shell panels apart properly separated when the insulation zone is evacuated, typically to 0.2 millitorrs (1 torr=1/760 atmosphere), causing these panels to become highly stressed due to atmospheric pressure.

Figure 4:
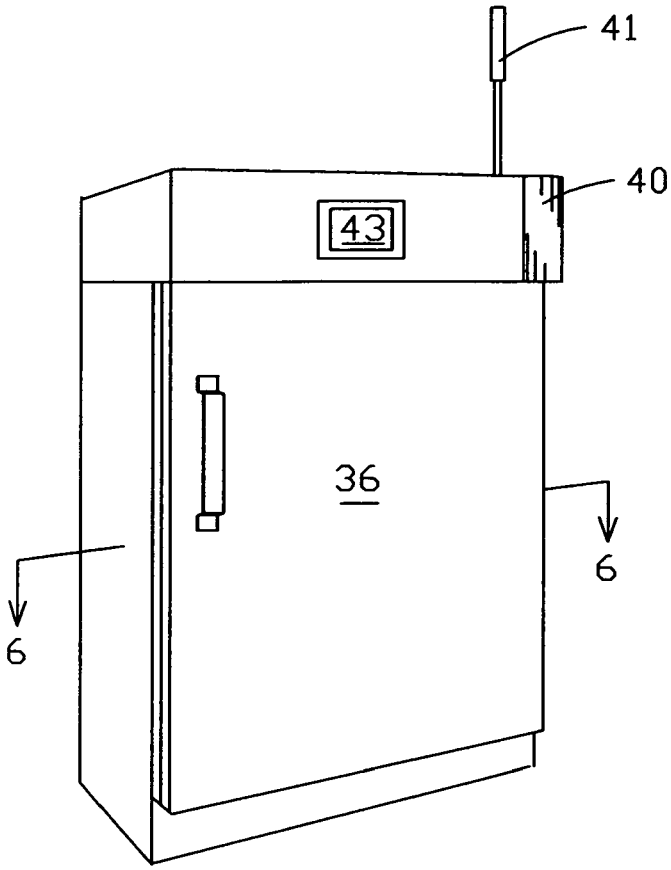
FIG. 4 is a three-dimensional view of a ULT freezer as in FIG. 3 completed with the addition of a main enclosure door, shown closed.

FIG. 4 is a perspective view of a ULT freezer 10 of the present invention as in FIG. 3 with the addition of an insulated main closure door 36 in place on the front. A cylindrical shroud 40 on a front corner above the hinged side of door 36 serves as a duct to enclose and protect flexible electrical wiring for temperature-monitoring probes, pneumatic tubing for pressurizing, warming and monitoring the door gaskets from the upper plenum region 24 and for actuating a pair of latch pins for door-locking. The actuators, remotely controlled, typically pneumatically, from the plenum control region, are located above and below the opening edge of the door 36 with the pins engaging openings in the top and bottom edges of the door 36 that latch it strongly for purposes of constraining against pressurizing of the seals. An optional status indicator 41 extending up from the top may be provided to indicate the status of the freezer, e.g. visual indication by colored light or aural alarm indication of abnormal conditions, e.g. if the interior temperature deviates beyond designated limits or in case of excessive duration/frequency of door opening A display panel 43 indicates operating data e.g. internal temperatures.

Figure 5:
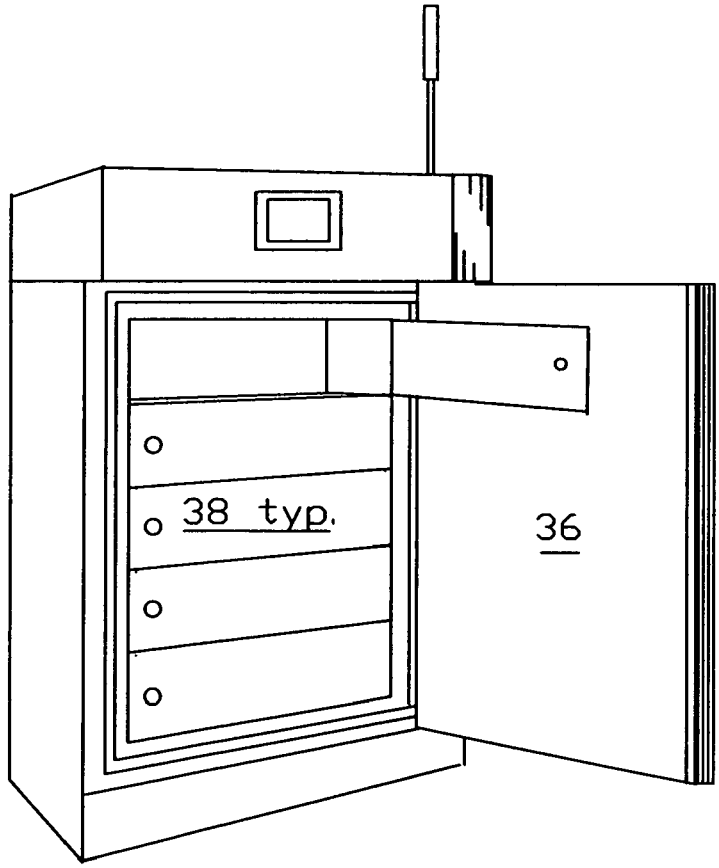
FIG. 5 depicts the ULT freezer of FIG. 4 with the main enclosure door opened to show the storage compartments each with a corresponding individual door.

FIG. 5 depicts the ULT freezer 10 of FIG. 4 with the main door opened for access to the storage compartments: five in this embodiment, each fitted with an individual door 38 for temperature independence. The top compartment is shown opened as it would be to add or remove sample payload/biological materials.

FIG. 6 is a cross-sectional view taken at axis 6-6 of FIG. 4 to show, surrounding a compartment shelf 28 in the storage chamber, the insulation and evaporator tubes in the sidewalls and rear wall, also showing main door 36 with insulation and hinge 40 and the associated compartment door 38 with insulation 38A and hinge 45.

FIG. 7 is an enlarged view of the circled left hand front corner region 7 of FIG. 6 showing the left hand sidewalls of outer shell 12 and inner shell 14 separated by and insulation filler made up from two layers 18A and 18B of insulation fill, intermediate partition 18C, evaporator tube 32 and a corner of the compartment base panel 28.

The portion shown depicts the main door 36 structured as with an air tight insulation zone with two layers 36A and 36B of insulation filler contained between outside panel 36C and inside panel 36D of stainless steel. The door-front façade 36E is spaced about an inch from outside panel 36*c* to provide a utility space for wiring and pneumatic tubing required by the door seal temperature monitoring and control systems.

Air-tight door sealing is accomplished by a stepped configuration of the perimeter of main door 36 and the associated jamb configuration including jam frame 26A welded in place around the front edges of the inner and outer shells, in cooperation with resilient door seals 42 and 46, each attached to the door around the perimeter, made of hollow resilient silicon tubing that can be pressurized for air-tight sealing in regular service and de-pressurized for easy access.

For long term reliability, seals 42 and 46 need to be protected against excessive low temperature that could render the material brittle. Built-in seal-warming elements, typically electrical, are provided and automatically controlled as required to avoid excessive ULT. The seal temperature is monitored by a set if probes such as probe 44 shown adjacent to the inner seal 44. Both the inner seal 46 and the outer seal 42 are warmed under control of a total of eight such probes located near the four corners of the door with connecting wire 48 run through special conduits 50 built into the door traversing the insulation zone as shown.

FIG. 8 is an enlarged view of the circled high hand rear corner region 8 of FIG. 6 showing the arrangement of the insulation layers in the corner. Typically the rear wall and the right hand sidewall are seen to be structured in the same manner as the left hand sidewall shown in FIG. 7 with two layers of insulation material.

This highly efficient insulation structure along with the utilizing of liquid nitrogen refrigerant in a sealed externally-vented evaporator provides accurate, effective and efficient cooling and freezing in a completely non-mechanical proven hybrid system that exhibits superior temperature uniformity and reliability, saves space, requires up to 90% less energy, minimizes air conditioning needs and provides excellent survival time period of several days of set point temperature retention in the event of electrical power failure or other malfunction.

A single freezer system of the present invention provides multiple temperatures from +20 to −150 degrees C. for high throughput applications or long term steady state use. For mass vaccine, tissue, and sample storage, programmable flexibility is provided for manufacturing or research processes that need multiple temperatures, ramps and at-temperature soak times.

Multiple data point monitoring enables thermal uniformity within +/−3 degrees C. or better throughout the entire interior storage space. Temperature recovery after sample removal is extremely fast.

An optional feature of maintaining positive pressure or at least equilibrium of internal and external barometric pressure in the storage chamber implemented by a compressor and associated control system in the plenum region reduces "inhalation" of external air, mitigates introduction of contaminants, and minimizes frost buildup.

The vacuum insulated system can hold temperature up to four days, depending on set temperature even if the liquid nitrogen supply and the electrical power supply are interrupted. Also the insulation system itself will continue to function effectively even if the vacuum is breached.

As an alternative to the use of liquid nitrogen refrigerant, the system is readily adaptable to the use of practically any other common evaporative refrigerant.

Regarding the patented multiple evaporator tubing system utilized, while one embodiment has been successful utilizing two side-by-side runs of tubing in the tubing assemblies, the invention could readily be practiced with three side-by-side runs of tubing in the assemblies, as shown in U.S. Pat. No. 6,804,976, or even more, since multiple runs can be selected and controlled in very flexible manner by the valves and controls in the plenum.

In addition to or as an alternative to the system of compartments described with solid shelves affixed inside the storage chamber forming barriers between compartments, individual storage boxes with front and/or top doors could be provided as air-tight isolated compartments; free sliding and removable or captivated, e.g. mounted on a pair of sliders.

As an alternative to the front-loading floor-based embodiment shown, the invention could be practiced in top-loading and/or table top embodiments.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An ultra low temperature freezer system for preserving payloads including biological materials at predetermined fixed and programmed variable temperatures in a range from −40 degrees C. to −150 degrees C., comprising:

an outer shell having a top panel, two opposite side panels, a rear panel and a bottom panel, all joined together with airtight seams to form an open-front box;

an inner shell having a top panel region, two opposite side panel regions, a rear panel region and a bottom panel region, all joined together with airtight seams to form an open-front box smaller than said outer shell:

a stepped door jamb made contiguous with front edges of said outer shell and said inner shell so as hold said inner shell nested within said outer shell in a manner to form an air tight insulation compartment consisting of orthogonal-shaped insulation zones at the top, two sides, back and bottom panel regions;

a storage chamber having a top panel, two opposite side panels, a rear panel and a bottom panel, all joined together with airtight seams to form an open-front box smaller than said inner shell and held nested therein so as to provide a plurality of orthogonal-shaped refrigerating zones between said inner shell and said storage chamber;

a main door, hingedly attached along a front side region of said outer shell, having a peripheral region configured in a stepped manner to complement said door jamb;

a plurality of compliant door-sealing elements, arranged in at least two complete loops, made and arranged to fit under compression between the peripheral region of said main door in a closed disposition and said door jamb in a manner to create an air-tight seal all around the peripheral region of said main door and thus render said storage chamber as an air-tight thermally-insulated refrigerated enclosure;

a plurality of thermally isolated storage compartments contained within said storage chamber, each providing an isolated storage space and an associated access door;

a plurality of refrigeration evaporator tubing units each disposed in a corresponding working refrigeration zone, each tubing unit comprising at least two side-by-side parallel runs of tubing in a corresponding refrigeration zone for reliability through redundancy, each run of tubing being made capable of fully operational evaporator capability independent of the other; and a manifold valve and control system made and arranged to supply refrigerant to said system of refrigeration in an operation manner that includes options of providing constant and controlled variable temperature operation within said storage chamber.

2. The ultra low temperature freezer system as defined in claim 1 further comprising:

insulation filler material disposed in at least four of the five working insulation zones and in the insulation zone of the main door, made and arranged to provide thermal insulation as well as to provide sufficient mechanical compression strength to enable the panel regions of said outer and inner shells to withstand continued operation under evacuation without excessive deformation of panel regions due to external atmospheric pressure.

3. The ultra low temperature freezer system as defined in claim 2 wherein, in at least the back and two side insulation zones, said insulation filler material is configured in two layers between said outer shell and said inner shell.

4. The ultra low temperature freezer system as defined in claim 2 further comprising:

insulation zone pressurizing means for initially purging moisture and atmospheric air from the insulation zones through displacement by introduction of a dry inert gas; and evacuation means for evacuating atmospheric air from the insulation zones and for maintaining a designated degree of vacuum for enhancement of thermal insulation performance and operating efficiency of the insulation zones.

5. The ultra low temperature freezer system as defined in claim 4 wherein all panels are made from sheet stainless steel.

6. The ultra low temperature freezer system as defined in claim 2 wherein said door-sealing elements in the door of the storage chamber are configured as compliant hollow tubing and are pressurized with a compressed gas in a manner to ensure air-tight sealing around said main door for enhanced thermal insulation and overall operating efficiency, including means for releasing the pressurization when the door is to be opened for access to the storage chamber and the individual storage compartments and for then restoring pressurization once the door has been closed again for normal service.

7. The ultra low temperature freezer system as defined in claim 2 wherein liquid nitrogen is utilized as refrigerant in an evaporation process, and wherein said system further comprises:

an input port made and arranged to be attached to an external source of liquid nitrogen refrigerant and to direct the refrigerant into the evaporator tubing; and an exhaust venting port made and arranged to conduct exhaust gases from the evaporation process safely to external ductwork leading to outdoor disposal facilities, so as to avoid exposure of personnel to the exhaust gases.

* * * * *